US012239160B2

(12) United States Patent
Antonopoulos et al.

(10) Patent No.: US 12,239,160 B2
(45) Date of Patent: Mar. 4, 2025

(54) DEVICE FOR HEATING AEROSOL-FORMING SUBSTRATE WITH AIR PREHEAT

(71) Applicant: PHILIP MORRIS PRODUCTS S.A., Neuchâtel (CH)

(72) Inventors: Roland Antonopoulos, Neuchâtel (CH); Teemu Maattanen, Bern (CH); Giovanna Landi, Mur (CH)

(73) Assignee: Philip Morris Products S.A., Neuchâtel (CH)

( * ) Notice: Subject to any disclaimer, the term of this patent is extended or adjusted under 35 U.S.C. 154(b) by 434 days.

(21) Appl. No.: 17/789,816

(22) PCT Filed: Dec. 10, 2020

(86) PCT No.: PCT/IB2020/061770
§ 371 (c)(1),
(2) Date: Jun. 29, 2022

(87) PCT Pub. No.: WO2021/137067
PCT Pub. Date: Jul. 8, 2021

(65) Prior Publication Data

US 2023/0043438 A1 Feb. 9, 2023

(30) Foreign Application Priority Data

Dec. 30, 2019 (EP) ..... 19220070

(51) Int. Cl.
*A24F 1/30* (2006.01)
*A24B 15/167* (2020.01)
(Continued)

(52) U.S. Cl.
CPC ..... *A24F 1/30* (2013.01)

(58) Field of Classification Search
None
See application file for complete search history.

(56) References Cited

U.S. PATENT DOCUMENTS

2008/0029107 A1* 2/2008 Ruff ..... A24F 1/30 131/335
2013/0247910 A1* 9/2013 Postma ..... A61M 15/0023 128/203.26
2018/0317546 A1* 11/2018 Rial ..... A24F 1/30

FOREIGN PATENT DOCUMENTS

EP 3216357 9/2017
WO 20060085126 8/2006
(Continued)

OTHER PUBLICATIONS

European Search Report for EP 19220070.7, issued by the European Patent Office on Aug. 5, 2020; 5 pgs.
(Continued)

*Primary Examiner* — Philip Y Louie
*Assistant Examiner* — Madeleine P Delacruz
(74) *Attorney, Agent, or Firm* — Mueting Raasch Group

(57) ABSTRACT

A shisha device comprises (i) a vessel having an interior volume configured to contain a liquid; and (ii) a receptacle configured to receive a cartridge including an aerosol-forming substrate. The shisha device comprises a heating element configured to heat the aerosol-forming substrate when the cartridge is received in the receptacle. The shisha device has a receptacle inlet in communication with, and upstream of, the receptacle and has a receptacle outlet in communication with, and downstream of, the receptacle. The shisha device comprises a conduit in communication with the receptacle outlet and extending into the vessel via the vessel inlet. The shisha comprises an air inlet channel in communication with an ambient environment and the receptacle inlet. The air inlet channel extends along an exterior of the conduit.

15 Claims, 2 Drawing Sheets

(51) Int. Cl.

| | |
|---|---|
| ***A24F 40/10*** | (2020.01) |
| ***A24F 40/42*** | (2020.01) |
| ***A24F 40/46*** | (2020.01) |
| ***A24F 40/485*** | (2020.01) |

(56) References Cited

FOREIGN PATENT DOCUMENTS

| | | | | |
|---|---|---|---|---|
| WO | 20160116296 | | 7/2016 | |
| WO | WO-2017178931 | A1 * | 10/2017 | ..... A24F 1/30 |
| WO | 20190003116 | | 1/2019 | |
| WO | 20190016737 | | 1/2019 | |
| WO | 20190234582 | | 12/2019 | |

OTHER PUBLICATIONS

International Search Report and Written Opinion for PCT/IB2020/061770, issued by the European Patent Office on Mar. 2, 2021; 8 pgs.

* cited by examiner

DEVICE FOR HEATING AEROSOL-FORMING SUBSTRATE WITH AIR PREHEAT

This application is the § 371 U.S. National Stage of International Application No. PCT/IB2020/061770, filed 10 Dec. 2020, which claims the benefit of European Application No. 19220070.7, filed 30 Dec. 2019.

This disclosure relates to aerosol-generating devices and systems that heat an aerosol-forming substrate to release one or more constituents of the substrate. More particularly, this disclosure relates to aerosol-generating devices and systems, such as shisha devices and systems, that heat an aerosol-forming substrate to release one or more constituents from the substrate without combusting the substrate.

Traditional shisha devices are used to smoke tobacco and are configured such that vapor and smoke pass through a water basin before inhalation by a consumer. Shisha devices may include one outlet, or more than one outlet so that the device may be used by more than one consumer at a time. Use of shisha devices is considered by some to be a leisure activity and a social experience.

Typically, traditional shishas are used in combination with a substrate, sometimes referred to in the art as hookah tobacco, tobacco molasses, or simply as molasses. Traditional shisha substrates are relatively high in sugar (in some cases, up to ~50% vs. the ~20% typically found in conventional tobacco substrates, such as in combustible cigarettes). The tobacco used in shisha devices may be mixed with other ingredients to, for example, increase the volume of the vapor and smoke produced, to alter flavour, or both.

Traditional shisha devices employ charcoal, such as charcoal pellets to heat and sometimes combust the tobacco substrate to generate an aerosol for inhalation by a user. Using charcoal to heat the tobacco may cause full or partial combustion of the tobacco or other ingredients. Additionally, charcoal may generate harmful or potentially harmful products, such as carbon monoxide, which may mix with the shisha vapor and pass through a water basin to an outlet.

One way to reduce the production of carbon monoxide and combustion by-products is to employ e-liquids rather than tobacco. Shisha devices that employ e-liquids eliminate combustion by-products but deprive shisha consumers of the traditional tobacco-based experience.

Other shisha devices have been proposed that employ electric heaters to heat, but not combust, tobacco. Such heat-not-burn shisha devices heat the tobacco substrate to a temperature sufficient to produce an aerosol from the substrate without combusting the substrate, and therefore reduce or eliminate by-products associated with combustion of tobacco. However, eliminating combustion of the substrate may result in lower aerosol production than what a user might expect from a shisha device. For example, the production of aerosol in terms of visible smoke or aerosol, total aerosol mass, or visible smoke or aerosol mass may be unsatisfactory for heat-not-burn shisha devices.

Further, electrically heating an aerosol-forming substrate may be an energy intensive process. If the shisha device is battery powered, the amount of time that the device may be used to heat the aerosol-forming substrate may be limited.

It is desirable to provide an aerosol-generating device, such as a shisha device, that efficiently heats the aerosol-forming substrate.

It is also desirable to provide a heat-not-burn aerosol-generating device, such as a heat-not-burn shisha device, that produces a satisfactory amount of aerosol.

Various embodiments of the present disclosure relate to an aerosol-generating device that comprises a conduit having an interior through which aerosol generated from heating of an aerosol-forming substrate flows and to an aerosol-generating device that comprises an airflow path that causes air to flow proximal to or contact an exterior surface of the conduit. Downstream of a region of proximal flow or contact with the conduit, the airflow path may direct air to the aerosol-forming substrate to carry subsequently generated aerosol to an outlet.

Such a configuration may advantageously pre-heat air flowing external to the conduit at the region at or proximal to exterior surface of the conduit by transferring heat from the aerosol flowing through the conduit to the air external to the conduit. Heating of the air prior to contact with the aerosol-forming substrate may improve the energy efficiency of the device. Transfer of heat may advantageously cool the aerosol flowing in the conduit. Cooling of the aerosol flowing in the conduit may advantageously increase visible aerosol volume, total aerosol mass, or both visible aerosol volume and total aerosol mass.

In various embodiments, the present disclosure relates to a shisha device. The shisha device may comprise a vessel comprising an interior volume configured to contain a liquid. The vessel may have a vessel inlet and a headspace outlet. The shisha device may further comprise a receptacle configured to receive an aerosol-forming substrate or to receive a cartridge comprising the aerosol-forming substrate. The shisha device may also comprise a heating element configured to heat the aerosol-forming substrate when the aerosol-forming substrate or the cartridge is received in the receptacle. The shisha device may comprise a receptacle inlet in communication with, and upstream of, the receptacle and may comprise a receptacle outlet in communication with, and downstream of, the receptacle. The shisha device may also comprise a conduit in communication with the receptacle outlet and extending into the vessel via the vessel inlet. The shisha device may comprise an air inlet channel in communication with an ambient environment and the receptacle inlet. The air inlet channel extends along an exterior of the conduit. The air inlet channel may define a path along the exterior of the conduit.

Advantageously, the shisha device described above may enable heat transfer between the interior of the conduit and an environment external to the conduit. The shisha device may enable heat transfer from an aerosol, or air entrained with aerosol, flowing through the conduit to air flowing through the air inlet channel which extends along an outer surface of the conduit, during use of the shisha device. This preheats air entering the system, improving device efficiency. At the same time, the heat transfer between the aerosol flowing through the conduit and the air flowing through the inlet channel along the outside of the conduit cools the aerosol flowing through the conduit. This increases aerosol volume and total aerosol mass. Advantageously, the user is thereby provided with a more authentic shisha experience.

Preferably, the conduit comprises thermally conductive material to facilitate transfer of heat between the aerosol and the air in the inlet channel.

The shisha device may comprise a heat exchange element. The heat exchange element may extend in a direction from the exterior of the conduit into the air inlet channel. The heat exchange element may advantageously facilitate transfer of heat from the aerosol in the conduit to air in the air inlet channel.

The heat exchange element may be integral with the conduit. The heat exchange element may comprise a fin. The heat exchange element may comprise multiple fins. The heat exchange element may extend substantially around a perimeter of the conduit. The heat exchange element may comprise a multiply finned element extending substantially around the conduit. The heat exchange element may comprise thermally conductive material. The conduit may comprise a thermally conductive material. In some embodiments, both the heat exchange element and the conduit may comprise thermally conductive material. Examples of thermally conducting materials that one or both of the heat exchange element and the conduit may comprise include stainless steel, aluminum, aluminum oxide, or an aluminum alloy.

The aerosol-generating devices and systems described in the present disclosure may be more energy efficient than existing or previously described aerosol-generating devices and systems. For example, preheating air before the air contacts the aerosol-forming substrate may result in reduced energy needing to be applied to a heater to heat the substrate to an extent sufficient to release one or more constituents of the substrate in an aerosol. In particular, preheating the air by transferring heat from the aerosol, rather than or in addition to from the heater, may be particularly energy efficient. In addition, cooling of the aerosol may enhance nucleation. Enhanced nucleation may result in enhanced visible aerosol volume, enhanced total aerosol mass, or both enhanced visible aerosol volume and enhanced total aerosol mass.

The terms used herein will have their generally accepted definitions unless otherwise defined herein.

The term "aerosol" is used herein to refer to a suspension of solid particles or liquid droplets, or a combination of solid particles and liquid droplets in a gas. The gas may be air. The solid particles or liquid droplets may comprise one or more volatile flavor compounds. Aerosol may be visible or invisible. Aerosol may include vapors of substances that are ordinarily liquid or solid at room temperature. Aerosol may include vapors of substances that are ordinarily liquid or solid at room temperature, in combination with solid particles or in combination with liquid droplets or in combination with both solid particles and liquid droplets. In some embodiments, the aerosol comprises nicotine.

The term "aerosol-forming substrate" is used herein to refer to a material capable of releasing one or more volatile compounds that can form an aerosol. In some embodiments, an aerosol-forming substrate may be heated to volatilize one or more components of the aerosol-forming substrate to form an aerosol. As an alternative to heating or combustion, in some cases volatile compounds may be released by a chemical reaction or by a mechanical stimulus, such as ultrasound. The aerosol-forming substrate may be disposed inside the cartridge. Aerosol-forming substrate may be solid or liquid or may comprise both solid and liquid components. Aerosol-forming substrate may be adsorbed, coated, impregnated or otherwise loaded onto a carrier or support. Aerosol-forming substrate may comprise nicotine. Aerosol-forming substrate may comprise plant-based material. Aerosol-forming substrate may comprise tobacco. Aerosol-forming substrate may comprise a tobacco-containing material containing volatile tobacco flavour compounds, which are released from the aerosol-forming substrate upon heating. Aerosol-forming substrate may alternatively comprise a non-tobacco-containing material. Aerosol-forming substrate may comprise homogenised plant-based material. Aerosol-forming substrate may comprise homogenised tobacco material. Aerosol-forming substrate may comprise at least one aerosol-former. Aerosol-forming substrate may comprise other additives and ingredients, such as flavourants.

The terms "upstream" and "downstream" refer to relative positions of elements of an aerosol-generating device, such as a shisha device, described in relation to the direction of air or aerosol as it is drawn through the device by applying negative relative pressure at a mouthpiece or mouth end of the device.

The terms "integral" and "integrally formed" are used herein to describe elements that are formed in one piece (a single, unitary piece). Integral or integrally formed components may be configured such that they cannot be separably removed from each other without causing structural damage to the piece.

As used herein, the singular forms "a," "an," and "the" also encompass embodiments having plural referents, unless the content clearly dictates otherwise.

As used herein, "or" is generally employed in its sense including "one or the other or both" unless the content clearly dictates otherwise.

The term "about" is used herein in conjunction with numeric values to include normal variations in measurements as expected by persons skilled in the art and is understood to have the same meaning as "approximately." The term "about" understood to cover a typical margin of error. A typical margin of error may be, for example, ±5% of the stated value.

As used herein, "have," "having," "include," "including," "comprise," "comprising" or the like are used in their open-ended sense, and generally mean "including, but not limited to". It will be understood that "consisting essentially of," "consisting of," and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure, including the claims.

The term "substantially" as used herein can be understood to modify the term that follows by at least about 90%, at least about 95%, or at least about 98%. The term "not substantially" as used herein can be understood to have the inverse meaning of "substantially," i.e., modifying the term that follows by not more than 10%, not more than 5%, or not more than 2%.

Any direction referred to herein, such as "top," "bottom," "left," "right," "upper," "lower," and other directions or orientations are described herein for clarity and brevity but are not intended to be limiting of an actual device or system. Devices and systems described herein may be used in a number of directions and orientations.

Below, there is provided a non-exhaustive list of non-limiting examples. Any one or more of the features of these examples may be combined with any one or more features of another example, embodiment, or aspect described herein.

A: A shisha device comprising (i) a vessel comprising an interior volume configured to contain a liquid, the vessel comprising a vessel inlet and a headspace outlet; (ii) a receptacle configured to receive an aerosol-forming substrate or to receive a cartridge comprising the aerosol-forming substrate; (iii) a heating element configured to heat the aerosol-forming substrate when the aerosol-forming substrate or the cartridge is received in the receptacle; (iv) a receptacle inlet in communication with, and upstream of, the receptacle; (v) a receptacle outlet in communication with, and downstream of, the receptacle; (vi) a conduit in communication with the receptacle outlet and extending into the vessel via the vessel inlet; and (vii) an air inlet channel in communication with an ambient environment and the receptacle inlet, wherein the air inlet channel extends along an outer surface of the conduit. The air inlet channel may define a path along an outer surface of the conduit.

B: The shisha device according to example A, comprising a heat exchange element extending from the outer surface of the conduit to at least partially define a portion of the air inlet channel.

C: The shisha device according to example B, wherein the heat exchange element is integrally formed with the conduit.

D: The shisha device according to example B or C, wherein the heat exchange element comprises a fin.

E: The shisha device according to any one of examples B to D, wherein the heat exchange element comprises a heat-conducting material.

F: The shisha device according to any one of the preceding examples, wherein the outer surface of the conduit comprises a heat-conducting material.

G: The shisha device according to example F, wherein the heat conducting material comprises aluminium, alumina, or an aluminium alloy.

H: The shisha device according to any of the preceding examples, wherein the heating element is configured to heat the aerosol-forming substrate to an extent sufficient to volatilize one or more components of the aerosol-forming substrate without combusting the aerosol-forming substrate.

I: The shisha device according to any one of the preceding examples, further comprising a controller operably coupled to the heating element, wherein the controller is configured to control heating of the heating element such that the heating element heats the aerosol-forming substrate to an extent sufficient to volatilize one or more components of the aerosol-forming substrate without combusting the aerosol-forming substrate.

J: The shisha device according to any one of the preceding examples, wherein the heating element forms at least a portion of the receptacle.

K: The shisha device according to any one of the preceding examples, wherein, in use, air travels from the ambient environment through the air inlet channel, to the receptacle inlet, through the receptacle, out the receptacle outlet, through the conduit, into the vessel, and out the headspace outlet.

L: The shisha device according to example K, wherein air flowing through the air inlet channel cools air flowing through the conduit.

M: A system comprising (i) a shisha device according to any one of the preceding examples; and (ii) the aerosol-forming substrate.

N: The system according to example M, wherein the aerosol-forming substrate is provided in a cartridge.

O: The system according to example M or N, wherein the aerosol-forming substrate comprises tobacco.

Aerosol-generating devices and systems described in the present disclosure may perform more efficiently than previous aerosol-generating systems and devices, may produce enhanced aerosol relative to previous aerosol-generating systems and devices, or may perform more efficiently and produce more aerosol than previous aerosol-generating devices and systems. The devices and systems described herein are configured to transfer heat from aerosol generated by heating an aerosol-forming substrate to air in a passageway, such as a channel, upstream of the aerosol-forming substrate. The passageway is in communication with the aerosol-forming substrate such that the heated air in the passageway may contact the aerosol-forming substrate and carry generated aerosol through the device to an outlet. Heating of the air in the passageway upstream of the aerosol-forming substrate may result in improved energy efficiency. Cooling of the aerosol may result in increased nucleation. Increased nucleation may result in enhanced visible aerosol volume, increased total aerosol mass, or both enhanced visible aerosol volume and increased total aerosol mass.

Visible aerosol volume may be determined in any suitable manner. For example, the volume or density of the aerosol may be observed by a user. In addition or alternatively, the density of the aerosol may be observed using a photometer or instrument configured to measure light scattering.

Total aerosol mass may be determined in any suitable manner. For example, aerosol may be collected on a filter or other suitable medium, such as a Cambridge pad, at an outlet of an aerosol-generating device during simulated use of the device. The mass of the pad before and after being exposed to the aerosol may be measured to determine the mass of the aerosol.

The remainder of the disclosure describes the aerosol-generating device in terms of a shisha device. However, it will be understood that the teachings presented herein may be applied to any suitable aerosol-generating device.

The shisha device may include a receptacle adapted to receive an aerosol-forming substrate or a cartridge comprising the aerosol forming substrate. Preferably, a cartridge comprises the aerosol-forming substrate.

The shisha device may include a heating element configured to contact or to be in proximity to a body of the cartridge when the cartridge is received in the receptacle. The heating element may form at least part of the receptacle. For example, the heating element may form at least a portion of the surface of the receptacle. The shisha cartridge may be configured to transfer heat from the heating element to the aerosol-forming substrate by conduction. In some embodiments, the heating element includes an electric heating element. In some embodiments, the heating element includes a resistive heating component. For example, the heating element may include one or more resistive wires or other resistive elements. The resistive wires may be in contact with a thermally conductive material to distribute heat produced over a broader area. Examples of suitable conductive materials include aluminum, copper, zinc, nickel, silver, and combinations thereof. The heating element may form at least a portion of the surface of the receptacle.

Preferably, the shisha device is configured to sufficiently heat the aerosol-forming substrate in the cartridge to form an aerosol from the aerosol-forming substrate but not to combust the aerosol-forming substrate. An aerosol may be formed from the aerosol-forming substrate by volatilizing one or more components of the aerosol-forming substrate. For example, the shisha device may be configured to heat the aerosol-forming substrate to a temperature in a range from about 150° C. to about 300° C.; more preferably from about 180° C. to about 250° C. or from about 200° C. to about 230° C. to volatilize one or more constituents of the aerosol-forming substrate.

The shisha device may include control electronics operably coupled to the heating element. The control electronics may be configured to control heating of the heating element. The control electronics may be configured to control the temperature to which the aerosol-forming substrate in the cartridge is heated. The control electronics may be provided in any suitable form and may, for example, include a controller or a memory and a controller. The controller may include one or more of an Application Specific Integrated Circuit (ASIC) state machine, a digital signal processor, a gate array, a microprocessor, or equivalent discrete or integrated logic circuitry. Control electronics may include memory that contains instructions that cause one or more components of the circuitry to carry out a function or aspect of the control electronics. Functions attributable to control electronics in this disclosure may be embodied as one or more of software, firmware, and hardware.

The electronic circuitry may include a microprocessor, which may be a programmable microprocessor. The electronic circuitry may be configured to regulate a supply of power. The power may be supplied to the heater element in the form of pulses of electrical current.

In some examples, the control electronics may be configured to monitor the electrical resistance of the heating element and to control the supply of power to the heating element depending on the electrical resistance of the heating element. In this manner, the control electronics may regulate the temperature of the resistive element.

The shisha device may include a temperature sensor, such as a thermocouple. The temperature sensor may be operably coupled to the control electronics to control the temperature of the heating element. The temperature sensor may be positioned in any suitable location. For example, the temperature sensor may be configured to insert into the cartridge when received within the receptacle to monitor the temperature of the aerosol-forming substrate being heated. In addition or alternatively, the temperature sensor may be in contact with the heating element. In addition or alternatively, the temperature sensor may be positioned to detect temperature at an aerosol outlet of the shisha device or a portion thereof. The sensor may transmit signals regarding the sensed temperature to the control electronics. The control electronics may adjust heating of the heating elements in response to the signal to achieve a suitable temperature at the sensor.

The control electronics may be operably coupled to a power supply. The shisha device may include any suitable power supply. For example, a power supply of a shisha device may be a battery or set of batteries. The batteries of the power supply may be one or more of rechargeable, removable and replaceable. Any suitable battery may be used. For example, heavy duty type or standard batteries existing in the market, such as used for industrial heavy-duty electrical power-tools. Alternatively, the power supply may be any type of electric power supply including a super or hyper-capacitor. Alternatively, the assembly may be connected to an external electrical power source, and electrically and electronically designed for such purpose. Regardless of the type of power supply employed, the power supply preferably provides sufficient energy for the normal functioning of the assembly for at least one shisha session until aerosol is depleted from the aerosol-forming substrate in the cartridge before being recharged or needing to connect to an external electrical power source. Preferably, the power supply provides sufficient energy for the normal functioning of the assembly for at least about 70 minutes of continuous operation of the device, before being recharged or needing to connect to an external electrical power source.

In one example, a shisha device includes an aerosol-generating element that includes a cartridge receptacle, a heating element, an aerosol outlet, and an air inlet. The cartridge receptacle is configured to receive a cartridge containing the aerosol-forming substrate. The heating element may define at least part of a surface of the receptacle.

The shisha device includes an air inlet channel in fluid connection with the receptacle. In use, when the aerosol-forming substrate inside the cartridge is heated, aerosol former components in the substrate vaporize. Air flowing from the air inlet channel through the cartridge becomes entrained with aerosol generated from the aerosol former components in the cartridge.

The air inlet channel may include one or more apertures through the cartridge receptacle. Air from outside the shisha device may flow through the channel and into the cartridge receptacle through the one or more apertures. If a channel includes more than one aperture, the channel may include a manifold. The manifold may direct air flowing through the channel to each aperture. Preferably, the shisha device includes two or more air inlet channels.

The cartridge includes one or more openings (such as inlets, outlets, or inlets and outlets) formed in the body to allow air to flow through the cartridge. Air that enters the cartridge may flow across or through, or both across and through the aerosol-forming substrate, entraining aerosol, and exiting the cartridge and receptacle via an aerosol outlet. From the aerosol outlet, the air carrying the aerosol enters a vessel of the shisha device.

The shisha device may include any suitable vessel defining an interior volume configured to contain a liquid and defining an outlet in the headspace above a liquid fill level. The vessel may include an optically transparent or opaque housing to allow a consumer to observe contents contained in the vessel. The vessel may include a liquid fill demarcation, such as a liquid fill line. The vessel housing may be formed of any suitable material. For example, the vessel housing may include glass or suitable rigid plastic material. Preferably, the vessel is removable from a portion of the shisha assembly comprising the aerosol-generation element to allow a consumer to fill, empty or clean the vessel.

The vessel may be filled to a liquid fill level by a consumer. The liquid preferably includes water, which may optionally be infused with one or more colorants, flavorants, or colorants and flavorants. For example, the water may be infused with one or both of botanical and herbal infusions.

Aerosol entrained in air exiting the aerosol outlet of the receptacle may travel through a conduit positioned in the vessel. The conduit may be coupled to the aerosol outlet of the aerosol-generating element and may have an opening below the liquid fill level of the vessel, such that aerosol flowing through the vessel flows through the opening of the conduit, then through the liquid, into headspace of the vessel and exits through a headspace outlet, for delivery to a consumer.

The headspace outlet may be coupled to a hose comprising a mouthpiece for delivering the aerosol to a consumer. The mouthpiece may include an activation element, such as a switch activatable by a user, a puff sensor arranged to detect a user puffing on the mouthpiece, or both a switch activatable by the user and a puff sensor. The activation element is operably coupled to the control electronics of the shisha device. The activation element may be wirelessly coupled to the control electronics. Activation of the activation element may cause the control electronics to activate the heating element, rather than constantly supplying energy to the heating element. Accordingly, the use of an activation element may serve to save energy relative to devices not employing such elements to provide on-demand heating rather than constant heating.

In various embodiments, at least a portion of the air inlet channel is defined by an outer surface of the conduit that carries the aerosol entrained in air exiting the aerosol outlet of the receptacle. The conduit preferably comprises thermally conductive material. The conduit may comprise any suitable thermally conductive material. Examples of suitable thermally conductive materials include aluminium, copper, zinc, nickel, silver, any alloys thereof, and combinations thereof. Preferably, the conduit comprises aluminium, alumina, or an aluminium alloy. The thermally conductive material may facilitate transfer of heat from aerosol in the conduit to air in the inlet channel.

The thickness of a wall of the conduit may also contribute to the ability of the conduit to facilitate transfer of heat from the aerosol in the conduit to air in the inlet channel. Thinner walls tend to result in more heat transfer than thicker walls.

The air inlet channel may extend partially, substantially, or completely around the perimeter of the conduit. The air inlet channel may extend along any suitable length of the conduit. It will be understood that the amount of heat transfer from the aerosol in the conduit to the air in the inlet channel will generally be proportional to the area of the outer surface of the conduit that defines a portion of the air inlet channel.

The shisha device may comprise a heat exchange element. The heat exchange element may extend from the outer surface of the conduit to at least partially define a portion of the air inlet channel. The heat exchange element may advantageously facilitate transfer of heat from the aerosol in the conduit to air in the air inlet channel.

The heat exchange element may comprise thermally conductive material. Examples of suitable thermally conductive materials include aluminium, copper, zinc, nickel, silver, any alloys thereof, and combinations thereof. Preferably, the heat exchange element comprises aluminium, alumina, or an aluminium alloy.

In some embodiments, the heat exchange element may be integral with the conduit. In some embodiments, the heat exchange element may be a separate part from the conduit. If the heat exchange element and the conduit are formed from separate parts, at least a portion of the heat exchange element preferably contacts the conduit.

The heat exchange element may comprise a fin. The heat exchange element may comprise multiple fins. The heat exchange element may extend substantially around a perimeter of the conduit. The heat exchange element may comprise a multiply finned element extending substantially around the conduit.

Downstream of the portion of the air inlet channel defined by the conduit and upstream of the receptacle inlet, a portion of the air inlet channel may be formed by the heating element or a thermally conductive material in thermal communication with the heating element. Air flowing through this portion may be further preheated prior to entering the receptacle inlet and contacting the aerosol-forming substrate.

For purposes of example, one method for using a shisha device as described herein is provided below in chronological order. The vessel may be detached from other components of the shisha device and filled with water. One or more of natural fruit juices, botanicals, and herbal infusions may be added to the water for flavouring. The amount of liquid added should cover a portion of the conduit but should not exceed a fill level mark that may optionally exist on the vessel. The vessel is then reassembled to the shisha device. A cartridge may be prepared by removing any removable layer (if present). A portion of the aerosol-generating element may be removed or opened to allow the cartridge to be inserted into the receptacle. The aerosol-generating element is then reassembled or closed.

The device may then be switched on. Switching on the device may initiate a heating profile of a heating element, to heat the aerosol-forming substrate to a temperature at or above a vaporization temperature but below a combustion temperature of the aerosol-forming substrate. The aerosol forming compounds of the aerosol-forming substrate vaporize, generating an aerosol. The user may puff on the mouthpiece as desired. The user may continue using the device as long as desired or until no more aerosol is visible or being delivered. In some embodiments, the device may be arranged to automatically shut off when the cartridge or a compartment of the cartridge is depleted of usable aerosol-forming substrate. In some embodiments, the consumer may refill the device with a new cartridge after, for example, receiving the cue from the device that the aerosol-forming substrate in the cartridge is depleted or nearly depleted. The shisha device may be switched off at any time by a consumer by, for example, switching off the device.

The shisha device may have any suitable air management. In one example, puffing action from the user will create a suction effect causing a low pressure inside the device which will cause external air to flow through an air inlet of the device, into the air inlet channel, and into the receptacle. The air may then flow through the cartridge in the receptacle and become entrained with aerosol produced from the aerosol-forming substrate. The air with entrained aerosol then exits the aerosol outlet of the receptacle, flows through the conduit to the liquid inside the vessel. The aerosol will then bubble out of the liquid and into head space in the vessel above the level of the liquid, out the headspace outlet, and through the hose and mouthpiece for delivery to the consumer. The flow of external air and the flow of the aerosol inside the shisha device may be driven by the action of puffing from the user.

Any suitable shisha cartridge may be used with a shisha device described in the present disclosure. The cartridge may comprise a body defining a cavity. Aerosol-forming substrate may be disposed in the cavity of the cartridge. The body may comprise one or more heat resistant materials. The body may comprise a heat resistant metal or polymer. The body may comprise a thermally conductive material. For example, the body may comprise any of aluminium, copper, zinc, nickel, silver, any alloys thereof, and combinations thereof. Preferably, the body comprises aluminium.

The cartridge may be of any suitable shape. For example, the cartridge may have a shape configured to be received by a shisha device. The cartridge may have a substantially cuboidal shape, cylindrical shape, frustoconical shape, or any other suitable shape. Preferably, the cartridge has a generally cylindrical shape or a frustoconical shape.

The shisha device is configured to heat the aerosol-forming substrate in the cartridge. The device may be configured to heat the aerosol-forming substrate in the cartridge by conduction. The cartridge is preferably shaped and sized to allow contact with, or minimize distance from, a heating element of the shisha device. Advantageously, this may provide efficient heat transfer from the heating element to the aerosol-forming substrate in the cartridge. The heat may be generated by any suitable mechanism, such as by resistive heating or by induction or by a combination of resistive heating and inductions. In order to facilitate inductive heating, the cartridge may be provided with a susceptor. For example, the cartridge body may be made from or include a material (for example, aluminum) that is capable of acting as a susceptor. In some embodiments, a susceptor material may be provided within the cavity of the cartridge. A susceptor material may be provided within the cavity of the cartridge in any form, for example a powder, a solid block, shreds, etc.

Any suitable aerosol-forming substrate may be provided in the cavity defined by the body of the cartridge. The aerosol-forming substrate is preferably a substrate capable of releasing volatile compounds. The aerosol-forming substrate is preferably a substrate capable of releasing compounds that may form an aerosol. The volatile compounds may be released by heating the aerosol-forming substrate. The volatile compounds may be released by a chemical reaction or by a mechanical stimulus, such as ultrasound. Aerosol-forming substrate may be solid or liquid or may comprise both solid and liquid components. Aerosol-forming substrate may be adsorbed, coated, impregnated or otherwise loaded onto a carrier or support.

The aerosol-forming substrate may comprise nicotine. The nicotine containing aerosol-forming substrate may comprise a nicotine salt matrix. The aerosol-forming substrate may comprise plant-based material. The aerosol-forming substrate preferably comprises tobacco. The tobacco containing material preferably comprises volatile tobacco flavor compounds, which are released from the aerosol-forming substrate upon heating. The aerosol-forming substrate may comprise homogenized tobacco material. Homogenized tobacco material may be formed by agglomerating particulate tobacco. The aerosol-forming substrate may alternatively or additionally comprise a non-tobacco-containing material. The aerosol-forming substrate may comprise homogenized plant-based material. Aerosol-forming substrate may comprise at least one aerosol-former. Aerosol-forming substrate may comprise other additives and ingredients, such as flavourants. Preferably, the aerosol-forming substrate is a shisha substrate. A shisha substrate is understood to mean a consumable material that is suitable for use in a shisha device. Shisha substrate may include molasses.

The aerosol-forming substrate may include, for example, one or more of: powder, granules, pellets, shreds, spaghettis, strips, or sheets. The aerosol-forming substrate may contain one or more of: herb leaf, tobacco leaf, fragments of tobacco ribs, reconstituted tobacco, homogenized tobacco, extruded tobacco, and expanded tobacco.

The aerosol-forming substrate may include at least one aerosol former. Suitable aerosol formers include compounds or mixtures of compounds which, in use, facilitate formation of a dense and stable aerosol and which are substantially resistant to thermal degradation at the operating temperature of the shisha device. Suitable aerosol formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly preferred aerosol formers are polyhydric alcohols or mixtures thereof, such as triethylene glycol, 1,3-butanediol and, most preferred, glycerine. The aerosol-forming substrate may include any suitable amount of an aerosol former. For example, the aerosol former content of the substrate may be equal to or greater than 5% on a dry weight basis, and preferably greater than 30% by weight on a dry weight basis. The aerosol former content may be less than about 95% on a dry weight basis. Preferably, the aerosol former content is up to about 55%.

The aerosol-forming substrate preferably includes nicotine and at least one aerosol former. In some embodiments, the aerosol former is glycerine or a mixture of glycerine and one or more other suitable aerosol formers, such as those listed above.

The aerosol-forming substrate may include other additives and ingredients, such as flavorants, sweeteners, etc. In some examples, the aerosol-forming substrate includes one or more sugars in any suitable amount. Preferably, the aerosol-forming substrate includes invert sugar. Invert sugar is a mixture of glucose and fructose obtained by splitting sucrose. Preferably, the aerosol-forming substrate includes from about 1% to about 40% sugar, such as invert sugar, by weight. In some example, one or more sugars may be mixed with a suitable carrier such as cornstarch or maltodextrin.

In some examples, the aerosol-forming substrate includes one or more sensory-enhancing agents. Suitable sensory-enhancing agents include flavorants and sensation agents, such as cooling agents. Suitable flavorants include natural or synthetic menthol, peppermint, spearmint, coffee, tea, spices (such as cinnamon, clove, ginger, or combination thereof), cocoa, vanilla, fruit flavors, chocolate, eucalyptus, geranium, eugenol, agave, juniper, anethole, linalool, and any combination thereof.

In some examples, the aerosol-forming substrate is in the form of a suspension. For example, the aerosol-forming substrate may include molasses. As used herein, "molasses" means an aerosol-forming substrate composition comprising about 20% or more sugar. For example, the molasses may include at least about 25% by weight sugar, such as at least about 35% by weight sugar. Typically, the molasses will contain less than about 60% by weight sugar, such as less than about 50% by weight sugar.

Any suitable amount of aerosol-forming substrate (for example, molasses or tobacco substrate) may be disposed in the cavity. In some preferred embodiments, about 3 g to about 25 g of the aerosol-forming substrate is disposed in the cavity. The cartridge may include at least 6 g, at least 7 g, at least 8 g, or at least 9 g of aerosol-forming substrate. The cartridge may include up to 15 g, up to 12 g; up to 11 g, or up to 10 g of aerosol-forming substrate. Preferably, from about 7 g to about 13 g of aerosol-forming substrate is disposed in the cavity.

The aerosol-forming substrate may be provided on or embedded in a thermally stable carrier. The term "thermally stable" is used herein to indicate a material that does not substantially degrade at temperatures to which the substrate is typically heated (e.g., about 150° C. to about 300° C.). The carrier may comprise a thin layer on which the substrate deposited on a first major surface, on second major outer surface, or on both the first and second major surfaces. The carrier may be formed of, for example, a paper, or paper-like material, a non-woven carbon fiber mat, a low mass open mesh metallic screen, or a perforated metallic foil or any other thermally stable polymer matrix. Alternatively, the carrier may take the form of powder, granules, pellets, shreds, spaghettis, strips or sheets. The carrier may be a non-woven fabric or fiber bundle into which tobacco components have been incorporated. The non-woven fabric or fiber bundle may comprise, for example, carbon fibers, natural cellulose fibers, or cellulose-derivative fibers.

The body of the cartridge may include one or more walls. In some embodiments, the body includes a top wall, a bottom wall, and a sidewall. The sidewall may be cylindrical or frustoconical, extending from the bottom to the top. The body may include one or more parts. For example, the sidewall and the bottom wall may be an integral single part.

The sidewall and the bottom wall may be two parts configured to engage one another in any suitable manner. For example, the sidewall and the bottom wall may be configured to engage one another by threaded engagement or interference fit. The sidewall and the bottom wall may be two parts joined together. For example, the sidewall and the bottom wall may be joined together by welding or by an adhesive. The top wall and sidewall may be a single integral part. The sidewall and the top wall may be two parts configured to engage one another in any suitable manner. For example, sidewall and the top wall may be configured to engage one another by threaded engagement or interference fit. The sidewall and the top wall may be two parts joined together. For example, the sidewall and the top wall may be joined together by welding or by an adhesive. The top wall, sidewall and bottom wall may all be a single integral part. The top wall, the sidewall, and the bottom wall may be three separate parts configured to engage one another in any suitable manner. For example, the top wall, the sidewall, and the bottom wall may be configured to engage by threaded engagement interference fit, welding, or an adhesive.

One or more walls of the body may form a heatable wall or surface. As used herein, "heatable wall" and "heatable surface" mean an area of a wall or a surface to which heat may be applied, either directly or indirectly. The heatable wall or surface may function as a heat transfer surface through which heat may be transferred from outside of the body to the cavity or to an internal surface of the cavity.

Preferably, the body of the cartridge has a length (for example, an axial length along a vertical center axis) of about 15 cm or less. In some embodiments, the body has a length of about 10 cm or less. The body may have an inside diameter of about 1 cm or more. The inside diameter of the body may be about 1.75 cm or more. The cartridge may have a heatable surface area in the cavity from about 25 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. In some embodiments, the body has a length in a range from about 3.5 cm to about 7 cm. The inside diameter of the body may be from about 1.5 cm to about 4 cm. The body may have a heatable surface area in the cavity from about 30 $cm^2$ to about 100 $cm^2$, such as from about 70 $cm^2$ to about 100 $cm^2$. The volume of the cavity may be from about 10 $cm^3$ to about 50 $cm^3$; preferably from about 25 $cm^3$ to about 40 $cm^3$. Preferably, the body is cylindrical or frustoconical.

The cartridge body may include one or more openings or ventilation holes through one or more walls of the body. The ventilation holes may be inlets, outlets, or both. The ventilation holes may be disposed at the bottom wall, top wall, sides, or a combination thereof, of the cartridge.

The cartridge may comprise a seal or layer covering the openings or ventilation holes prior to use. The seal is preferably sufficient to prevent air flow through the openings or ventilation holes to prevent leakage of the contents of the cartridge and to extend shelf life. The seal may comprise a peelable label of sticker, foil, or the like. The label, sticker, or foil may be affixed to the cartridge in any suitable manner, such as with an adhesive, crimping, welding, or otherwise being joined to the container. The seal may comprise a tab that may be grasped to peel or remove the label, sticker, or foil from the cartridge.

The cartridge may include one or more inlets and one or more outlets. The one or more inlets and one or more outlets allow air to flow through the aerosol-forming substrate when the cartridge is used with the shisha device. In some embodiments, the top wall of the cartridge may be absent or may define one or more openings to form the one or more inlets of the cartridge. The bottom wall of the cartridge may define one or more openings to form the one or more outlets of the cartridge.

The one or more inlets and outlets may be sized and shaped to provide a suitable resistance to draw (RTD) through the cartridge. In some examples, the RTD through the cartridge, from the inlet or inlets to the outlet or outlets, may be from about 10 mm $H_2O$ to about 50 mm $H_2O$, preferably from about 20 mm $H_2O$ to about 40 mm $H_2O$. The RTD of a specimen refers to the static pressure difference between the two ends of the specimen when it is traversed by an air flow under steady conditions in which the volumetric flow is 17.5 milliliters per second at the output end. The RTD of a specimen may be measured using the method set out in ISO Standard 6565:2002.

The one or more openings on the body may cover 5% or greater, 10% or greater, 15% or greater, 20% or greater, or 25% or greater of the area of the wall the openings are on. For example, if the openings are on the top wall, the openings may cover at least 5% of the area of the top wall. The one or more openings on the body may cover 75% or less, 50% or less, 40% or less, or 30% or less of the area of the wall the openings are on.

Reference will now be made to the drawings, which depict one or more aspects described in this disclosure. However, it will be understood that other aspects not depicted in the drawings fall within the scope and spirit of this disclosure.

Like numbers used in the figures refer to like components. The use of different numbers to refer to components in different figures is not intended to indicate that the different numbered components cannot be the same or similar to other numbered components. The figures are presented for purposes of illustration and not limitation. Schematic drawings presented in the figures are not necessarily to scale.

Figure 1:
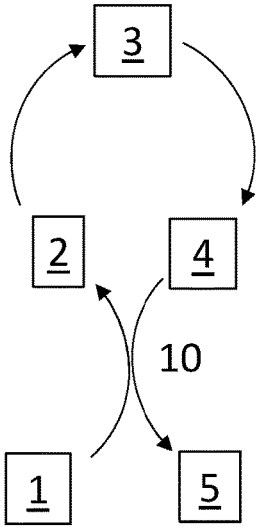
FIG. 1 is a schematic overview illustrating an embodiment of a principle of operation of an aerosol-generating device in accordance with the teachings presented herein.

FIG. 1 is a schematic overview illustrating an embodiment of a principle of operation of an aerosol-generating device in accordance with the teachings presented herein. As shown in FIG. 1, ambient air 1 enters the aerosol-generating device and flows through a location where heat from aerosol is transferred to the air 1 to produce heated air 2. The heated air 2 may then contact heated aerosol-forming substrate 3 to entrain one or more volatilized components in a heated aerosol 4. The heated aerosol 4 flows past the location where heat is transferred 10 to the incoming air 1, which cools the aerosol to result in cooled aerosol 5. Thus, the scheme shown in FIG. 1 illustrates the concept of thermal energy recycling in accordance with the teachings presented herein.

Preheating the air as shown in FIG. 1 may result in a more energy efficient aerosol-generating device because less energy may be needed to heat the aerosol forming substrate to an extent sufficient to volatilize one or more components of the substrate without combusting the substrate.

Cooling the aerosol as shown in FIG. 1 may result in increased nucleation of the aerosol. Increased nucleation may result in increased aerosol production. For example, one or both of visible aerosol volume and total aerosol mass may be increased.

Figure 2:
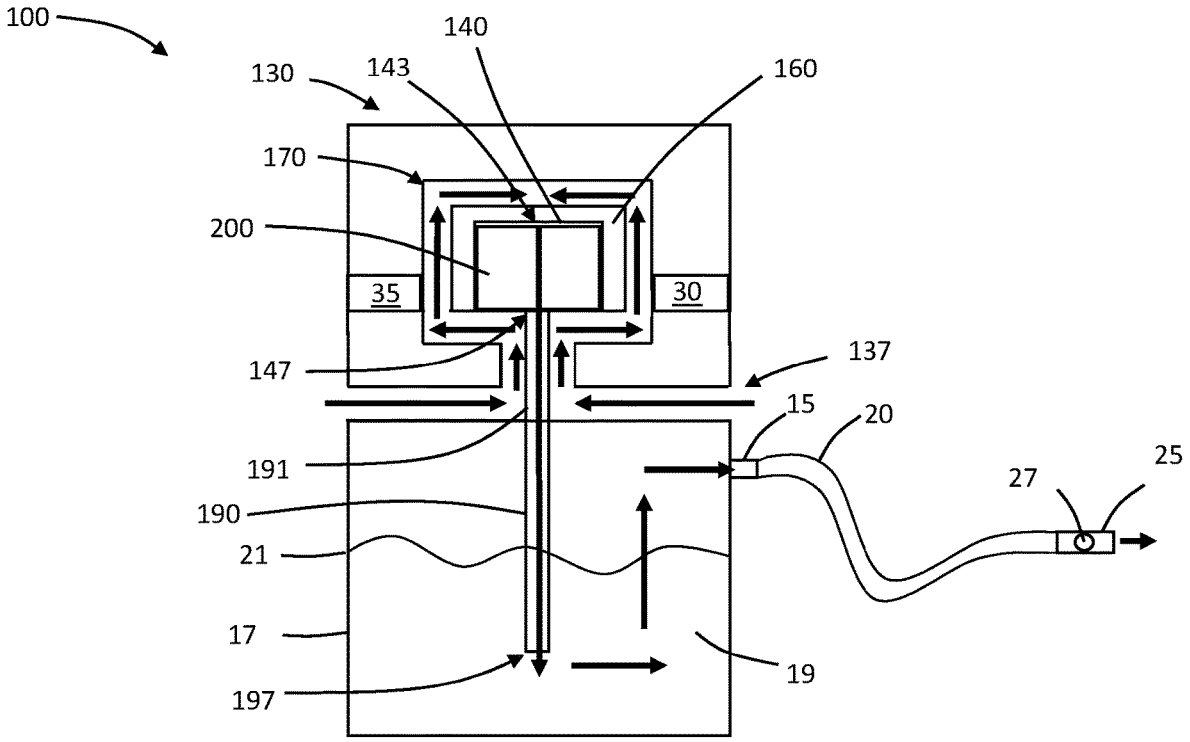
FIG. 2 is a schematic sectional view of an example of a shisha device.

FIG. 2 is a schematic sectional view of an example of a shisha device 100. The shisha device includes control electronics 30 and power supply 35. The shisha device 100 also includes a vessel 17 defining an interior volume configured to contain liquid 19 and defining a headspace outlet 15 above a fill level for the liquid 19. The liquid 19 preferably includes water, which may optionally be infused with one or more colorants, one or more flavourants, or one or more colorants and one or more flavourants. For example, the water may be infused with one or both of botanical infusions and herbal infusions.

The device 100 also includes an aerosol-generating element 130. The aerosol-generating element 130 includes a receptacle 140 configured to receive a cartridge 200 comprising an aerosol-forming substrate. The aerosol-generating element 130 may also include a heating element 160. The heating element 160 may form at least one surface of the receptacle 140. In the depicted embodiment, the heating element 160 defines the side surfaces of the receptacle 140. The heating element 160 is operably coupled to the control electronics 30 and the power supply 35.

The aerosol-generating element 130 also includes an air inlet channel 170 that draws air into the device 100 through inlet 137. A portion of the air inlet channel 170 extends along an outer surface 191 of the conduit 190. For example, at least a portion of the air inlet channel 170 may be defined by the outer surface 191 of conduit 190. Heated aerosol flows through the interior of the conduit 190. Heat from the aerosol may be transferred via the conduit 190 to air in the inlet channel 170.

A portion of the air inlet channel 170 may optionally be formed by the heating element 160 to optionally further heat the air before the air enters the receptacle 140. The preheated air enters the receptacle 140 through receptacle inlet 143, entering the cartridge 200 to carry aerosol generated by the aerosol former and the aerosol-forming substrate. The air exits an outlet 147 of the aerosol-generating element 130 and enters the conduit 190.

The conduit 190 carries the air and aerosol into the vessel 17 below the level of the liquid 19. The air and aerosol may bubble through the liquid 19 and exit the headspace outlet 15 of the vessel 17. A hose 20 may be attached to the headspace outlet 15 to carry the aerosol to the mouth of a user. A mouthpiece 25 may be attached to, or form a part of, the hose 20.

An exemplary air flow path of the device, in use, is depicted by thick arrows in FIG. 2. As shown in the air flow path, air from an external environment enters the device 100 through inlet 137, then passes along outer surface 191 of conduit 190, where it is preheated by heat exchange with aerosol in the conduit 190, then around outside of the receptacle 140 (optionally past heating element 160), then entering the receptacle 140 at an inlet 143, then through the substrate in the cartridge 200 in the receptacle 140 where one or more volatilized components of the substrate are entrained in the air to form an aerosol. The aerosol then flows out the receptacle outlet 147 and down the conduit 190. As the aerosol travels down the conduit 190, it is cooled by more air entering at inlet 137 that is flowing through channel 170 past the outer surface 191 of the conduit 191, exchanging heat with the aerosol in the conduit 190. The cooled aerosol exits the conduit 190 through a conduit outlet 197 below liquid fill level 21. Then, the aerosol may bubble through the liquid 19, exit the headspace outlet 15, flow through the hose 20, and exit the mouthpiece 25.

The mouthpiece 25 may include an activation element 27. The activation element 27 may be a switch, button or the like, or may be a puff sensor or the like. The activation element 27 may be placed at any other suitable location of the device 100. The activation element 27 may be in wireless communication with the control electronics 30 to place the device 100 in condition for use or to cause control electronics to activate the heating element 160; for example, by causing power supply 35 to energize the heating element 160.

The control electronics 30 and power supply 35 may be located in any suitable position of the aerosol-generating element 130, including locations other than the bottom portion of the element 130 as depicted in FIG. 1.

Figure 3:
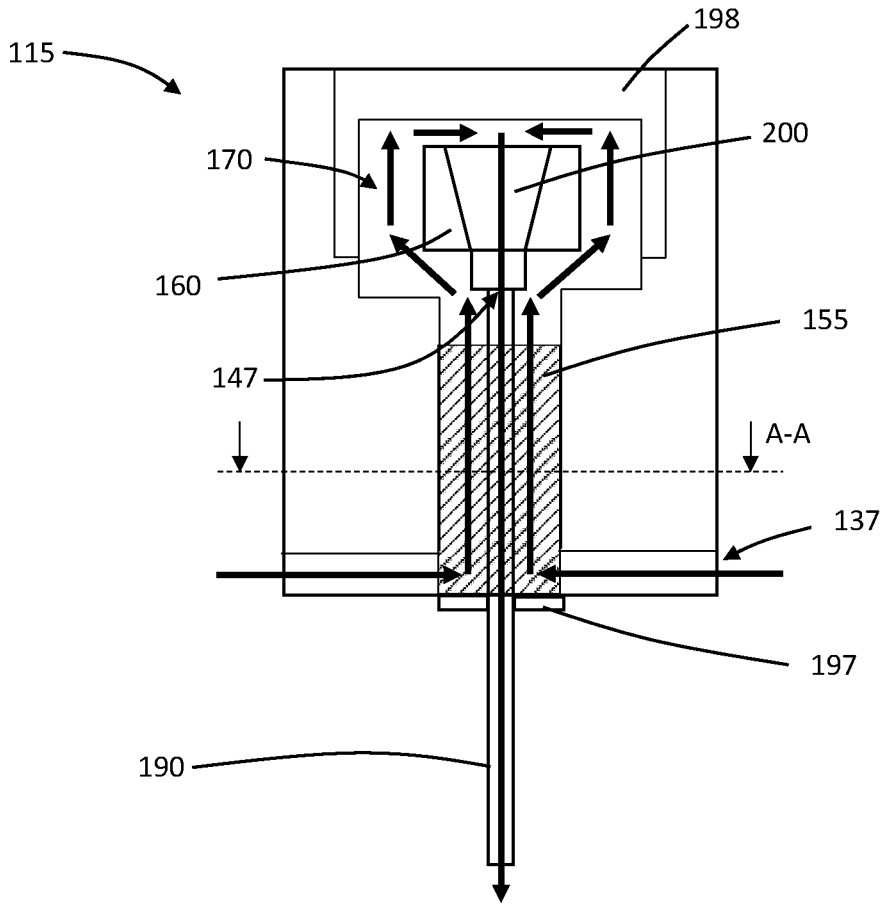
FIG. 3 is a schematic sectional view of an embodiment of a top portion of a shisha device.

FIG. 3 is a schematic sectional view of an embodiment of a top portion 115 of a shisha device. The top portion 115 may be removably coupled with a vessel portion (not shown in FIG. 3). The top portion 115 includes a lid 198 that may be opened to allow insertion of a cartridge 200 comprising aerosol generating substrate into a receptacle such that the cartridge 200 is in contact with, or close proximity to, heating element 160. Heating element 160 may form a portion of the surface of the receptacle configured to receive the cartridge 200. The top portion 115 includes a conduit 190 extending from the receptacle outlet 147 beyond a bottom of a base of the top portion 115 such that, when the top portion 115 is coupled to the vessel, the conduit extends in the vessel below a liquid fill level. A seal 197, such as an o-ring, may be disposed about the conduit 190 at the base of the top portion 115. The top portion 115 includes an inlet 137 to allow ambient air to enter air inlet channel 170. At least a portion of the air inlet channel 170 is formed by an outer surface of the conduit 190. The air inlet channel 170 is optionally partially defined by an outer surface of the heating element 160.

A heat exchange element 155 extends from the outer surface of the conduit 190 into, and defining at least a part of, the air inlet channel 170. Heat may be transferred from heated aerosol flowing through the conduit 190 to air flowing through the air inlet channel 170. The heat exchange element 155 may facilitate the transfer of heat. The heat exchange element 155 has a large surface area relative to the external surface of the conduit 190. The relative ratio of surface area contributes to the heat exchange effect. The heat exchange improves the energy consumption of the shisha device due to recycling of thermal energy. This results in improved energy efficiency of the shisha device due to a reduction in the amount of energy needed to generate aerosol from the aerosol-forming substrate in the cartridge 200.

An exemplary air flow path of the device, in use, is depicted by thick arrows in FIG. 3.

While in use, ambient air, with its atmospheric characteristics in terms of temperature and humidity, is drawn into the inlet 137 and through air inlet channel 170. When passing the heat exchange element 155, the air heats up, cooling down the aerosol inside the conduit 190. The air is preheated even before optionally contacting the heating element 160, where the air may be further preheated prior to entering the cartridge 200 to contact the aerosol-forming substrate and entrain volatilized constituents to be carried through the conduit 190.

Figure 4:
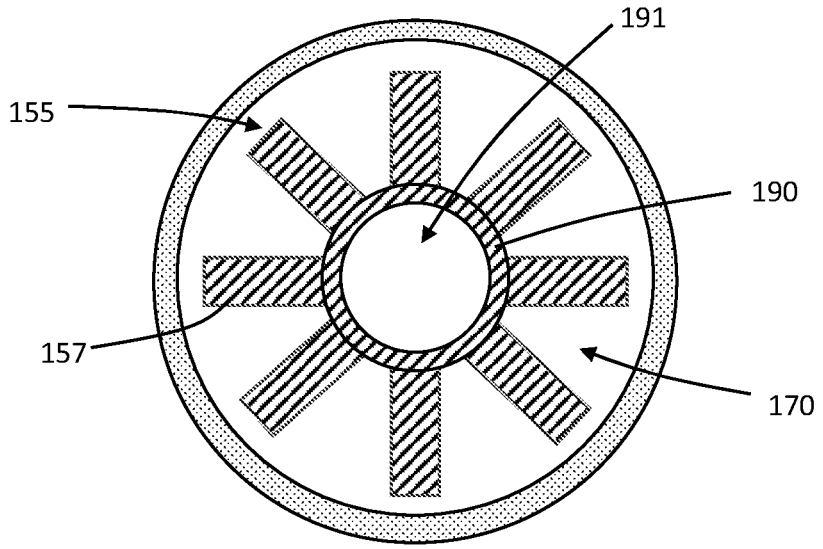
FIG. 4 is an embodiment of a schematic top cross-sectional view taken at line A-A of FIG. 3.

FIG. 4 is an embodiment of a schematic top cross-sectional view taken at line A-A of FIG. 3. The heat exchange element 155 includes a plurality of fins 157 extending from the outer surface of the conduit 190 into, and at least partially defining, the air inlet channel 170. As heated aerosol flows through the interior cavity 191 of the conduit 190, heat is transferred to air in the inlet channel 170 via the conduit 190 and the heat exchange element 155. The heat exchange element 155 and the conduit 190 may be integrally formed.

The fins 155 may be of any suitable shape. For example, the fins may be helix-shaped or of any other suitable shape that facilitates heat transfer from the aerosol in cavity 191 of the conduit 190 to air in the air inlet channel 170. The heat exchange element 155 may have any suitable number of fins.

Thus, shisha devices configured to recapture thermal energy are described. Various modifications and variations of the invention will be apparent to those skilled in the art without departing from the scope and spirit of the invention. Although the invention has been described in connection with specific preferred embodiments, it should be understood that the invention as claimed should not be unduly limited to such specific embodiments. Indeed, various modifications of the described modes for carrying out the invention which are apparent to those skilled in the mechanical arts, chemical arts, and aerosol-generating article manufacturing or related fields are intended to be within the scope of the following claims.

The invention claimed is:

1. A shisha device comprising:

a vessel comprising an interior volume configured to contain a liquid, the vessel comprising a vessel inlet and a headspace outlet;

a receptacle configured to receive an aerosol-forming substrate or to receive a cartridge comprising the aerosol-forming substrate;

a heating element configured to heat the aerosol-forming substrate when the aerosol-forming substrate or the cartridge comprising the aerosol-forming substrate is received in the receptacle;

a receptacle inlet in communication with, and upstream of, the receptacle;

a receptacle outlet in communication with, and downstream of, the receptacle;

a conduit in communication with the receptacle outlet and extending into the vessel via the vessel inlet; and an air inlet channel in communication with an ambient environment and the receptacle inlet, wherein the air inlet channel extends along an outer surface of the conduit.

2. The shisha device according to claim 1, comprising a heat exchange element extending from the outer surface of the conduit to at least partially define a portion of the air inlet channel.

3. The shisha device according to claim 2, wherein the heat exchange element is integrally formed with the conduit.

4. The shisha device according to claim 2, wherein the heat exchange element comprises a fin.

5. The shisha device according to claim 2, wherein the heat exchange element comprises a heat-conducting material.

6. The shisha device according to claim 1, wherein the conduit comprises a heat-conducting material.

7. The shisha device according to claim 6, wherein the heat conducting material comprises aluminum, alumina, or an aluminum alloy.

8. The shisha device according to claim 1, wherein the heating element is configured to heat the aerosol-forming substrate to an extent sufficient to volatilize one or more components of the aerosol-forming substrate without combusting the aerosol-forming substrate.

9. The shisha device according to claim 1, further comprising a controller operably coupled to the heating element, wherein the controller is configured to control heating of the heating element such that the heating element heats the aerosol-forming substrate to an extent sufficient to volatilize one or more components of the aerosol-forming substrate without combusting the aerosol-forming substrate.

10. The shisha device according to claim 1, wherein the heating element forms at least a portion of the receptacle.

11. The shisha device according to claim 1, wherein, in use, air travels from the ambient environment through the air inlet channel, to the receptacle inlet, through the receptacle, out the receptacle outlet, through the conduit, into the vessel, and out the headspace outlet.

12. The shisha device according to claim 11, wherein air flowing through the air inlet channel cools air flowing through the conduit.

13. The system comprising:

a shisha device according to claim 1; and an aerosol-forming substrate.

14. The system according to claim 13, wherein the aerosol-forming substrate is provided in a cartridge.

15. The system according to claim 13, wherein the aerosol-forming substrate comprises tobacco.

* * * * *